US012674322B1

(12) United States Patent
Kiik et al.

(10) Patent No.: US 12,674,322 B1
(45) Date of Patent: Jul. 7, 2026

(54) ROOFING SHINGLE

(71) Applicant: BMIC LLC, Dallas, TX (US)

(72) Inventors: Mike Kiik, Richardson, TX (US); Ming-Liang Shiao, Collegeville, PA (US); James A. Svec, Kearny, NJ (US); Zackary Geurin, Dallas, TX (US); Bryan Hill, Dallas, TX (US); Michael Kjelson, Dallas, TX (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 19/341,844

(22) Filed: Sep. 26, 2025

Related U.S. Application Data

(60) Provisional application No. 63/699,482, filed on Sep. 26, 2024.

(51) Int. Cl.
*E04D 1/28* (2006.01)
*E04D 1/00* (2006.01)
*E04D 1/26* (2006.01)

(52) U.S. Cl.
CPC ..... *E04D 1/28* (2013.01); *E04D 1/26* (2013.01); *E04D 2001/005* (2013.01)

(58) Field of Classification Search
CPC ..... E04D 1/28; E04D 1/26; E04D 2001/005
See application file for complete search history.

(56) References Cited

U.S. PATENT DOCUMENTS 5,369,929 A * 12/1994 Weaver ..... E04D 1/26 52/518
5,375,387 A 12/1994 Davenport
5,611,186 A 3/1997 Weaver
5,666,776 A 9/1997 Weaver et al.
5,853,858 A 12/1998 Bondoc
5,901,517 A 5/1999 Stahl et al.
6,014,847 A 1/2000 Phillips
6,105,329 A 8/2000 Bondoc et al.
6,190,754 B1 2/2001 Bondoc et al.
6,289,648 B1 9/2001 Freshwater et al.
6,361,851 B1 3/2002 Sieling et al.
6,440,216 B1 8/2002 Aschenbeck
6,457,290 B1 10/2002 Elliott
6,467,235 B2 10/2002 Kalkanoglu et al.
D466,629 S 12/2002 Phillips
6,582,760 B2 6/2003 Aschenbeck
6,698,151 B2 * 3/2004 Elliott ..... E04D 1/28 52/557
6,790,307 B2 * 9/2004 Elliott ..... B05D 1/30 427/398.1

(Continued)

FOREIGN PATENT DOCUMENTS

CA 1122770 A 5/1982
EP 1659233 B1 7/2008

*Primary Examiner* — Rodney Mintz
(74) *Attorney, Agent, or Firm* — GREENBERG TRAURIG, LLP

(57) ABSTRACT

A roofing shingle for installation as part of a roofing structure includes at least one layer of a shingle material having a top surface and a bottom surface. The roofing single will include a headlap portion and an exposure portion having a plurality of tabs with a plurality of granules being applied along the top surface. Shadow lines are defined at selected locations along the top surface of the roofing shingle to provide the roofing shingles with a selected visual appearance.

20 Claims, 8 Drawing Sheets

(56) References Cited

U.S. PATENT DOCUMENTS 6,823,637 B2 11/2004 Elliott et al.
6,990,779 B2 1/2006 Kiik et al.
7,240,462 B2 7/2007 Elliott et al.
7,665,261 B2 2/2010 Elliott et al.
7,805,905 B2 10/2010 Rodrigues et al.
7,827,753 B2 11/2010 Nagarajan et al.
7,877,949 B1 * 2/2011 Elliott ..... E04D 1/26 52/554
D644,753 S * 9/2011 Elliott ..... E04D 1/26 D25/139
8,197,893 B2 * 6/2012 Leitch ..... C09D 7/62 427/188
8,776,471 B2 * 7/2014 Jenkins ..... E04D 1/26 428/141
8,789,332 B1 * 7/2014 Halliley ..... B65D 83/0894 206/323
8,898,987 B1 12/2014 Amatruda et al.
8,925,272 B1 1/2015 Amatruda et al.
9,021,760 B2 * 5/2015 Kiik ..... E04D 1/28 52/518
9,091,086 B2 * 7/2015 Michalski ..... E04F 13/0894
9,187,903 B1 11/2015 Buzza
9,212,487 B2 12/2015 Kiik et al.
9,279,255 B2 * 3/2016 Bryson ..... E04D 1/26
9,290,945 B2 * 3/2016 Beerer ..... E04D 1/26
9,359,765 B2 6/2016 Svec
9,464,439 B2 10/2016 Buzza
9,498,795 B2 11/2016 Svec
9,555,439 B2 1/2017 Svec
9,739,062 B2 8/2017 Leitch
9,752,324 B2 * 9/2017 Leitch ..... E04D 5/12
D799,721 S 10/2017 Leitch
10,174,504 B1 * 1/2019 Freiborg ..... B32B 3/26
10,180,002 B2 1/2019 Freiborg
10,180,003 B2 1/2019 Freiborg
10,526,787 B2 1/2020 Jenkins et al.
10,584,493 B2 3/2020 Jenkins et al.
11,213,851 B2 1/2022 Svec
11,555,311 B2 1/2023 Jenkins et al.
11,680,409 B2 * 6/2023 Boss ..... E04D 1/20 428/98
11,946,254 B2 * 4/2024 Mercado ..... E04D 1/34
12,044,011 B2 * 7/2024 Boss ..... E04D 1/20
12,281,943 B1 * 4/2025 Ellis ..... E04D 1/20
12,366,069 B2 7/2025 Boss et al.
2001/0000372 A1 * 4/2001 Kalkanoglu ..... E04D 1/26 52/557
2002/0160108 A1 * 10/2002 Aschenbeck ..... E04D 1/26 118/201
2002/0174617 A1 * 11/2002 Elliott ..... E04D 1/28 52/518
2003/0040241 A1 * 2/2003 Kiik ..... B32B 5/26 442/242
2003/0138601 A1 7/2003 Elliott
2004/0123543 A1 * 7/2004 Elliott ..... E04D 1/26 52/518
2005/0193673 A1 * 9/2005 Rodrigues ..... B32B 5/26 52/518
2006/0059834 A1 * 3/2006 Elliott ..... E04D 1/26 52/557
2007/0068108 A1 * 3/2007 Kiik ..... E04D 1/26 52/518
2007/0137131 A1 * 6/2007 Nagarajan ..... B32B 5/26 52/518
2009/0117329 A1 * 5/2009 Leitch ..... E04D 5/02 427/213
2011/0185668 A1 * 8/2011 Kiik ..... E04D 1/28 52/518
2011/0209428 A1 * 9/2011 Elliott ..... E04D 1/26 52/526
2012/0180948 A1 7/2012 Aschenbeck
2013/0025226 A1 * 1/2013 Jenkins ..... E04D 1/26 52/557
2013/0298490 A1 * 11/2013 Jenkins ..... E04D 1/28 52/557
2014/0044871 A1 * 2/2014 Svec ..... B05D 5/02 118/308
2014/0202109 A1 * 7/2014 Michalski ..... E04F 13/0875 428/156
2014/0208675 A1 * 7/2014 Beerer ..... E04D 1/28 156/60
2014/0260078 A1 * 9/2014 Bryson ..... E04D 1/22 428/150
2015/0044365 A1 * 2/2015 Svec ..... B05C 19/06 118/308
2015/0072073 A1 * 3/2015 Svec ..... B05C 19/06 427/188
2015/0315790 A1 * 11/2015 Buzza ..... E04D 1/12 52/559
2016/0160505 A1 * 6/2016 Jenkins ..... E04D 1/12 52/525
2016/0177569 A1 * 6/2016 Leitch ..... E04D 1/26 52/559
2016/0265229 A1 9/2016 Leitch
2017/0073973 A1 * 3/2017 Jenkins ..... B05D 5/061
2018/0363300 A1 * 12/2018 Freiborg ..... E04D 1/2963
2018/0363301 A1 * 12/2018 Freiborg ..... E04D 1/20
2019/0284807 A1 * 9/2019 Freiborg ..... B32B 5/16
2021/0047833 A1 * 2/2021 Jenkins ..... B32B 5/142
2021/0114058 A1 * 4/2021 Svec ..... B05D 1/30
2022/0056695 A1 * 2/2022 Mercado ..... D06N 3/0011
2022/0298793 A1 * 9/2022 Boss ..... E04D 1/20
2023/0183979 A1 * 6/2023 Ellis ..... E04D 1/20 428/143
2023/0272617 A1 * 8/2023 Boss ..... E04D 1/20 428/98
2023/0338986 A1 10/2023 Mishler
2024/0337103 A1 * 10/2024 Boss ..... E04D 1/20
2025/0216263 A1 * 7/2025 Ellis ..... G01J 3/463
2025/0320721 A1 * 10/2025 Boss ..... E04D 1/20

* cited by examiner

ROOFING SHINGLE

CROSS-REFERENCE TO RELATED APPLICATIONS

This application claims priority to U.S. Provisional Patent Application No. 63/699,482, filed Sep. 26, 2024, and titled "ROOFING SHINGLE," the disclosure of which application is hereby incorporated herein by reference in its entirety.

FIELD

The present disclosure relates to roofing shingles and roofing systems, and in particular to roofing shingles having a visual appearance of increased thickness and/or an appearance of more expensive roofing materials and a roofing system that utilizes the roofing shingles.

BACKGROUND

Roofs can be constructed using roofing shingles, tiles, wood shakes, slate, or other roofing materials that can be selected to provide different aesthetic features and visual appearances to the roof.

SUMMARY

Some embodiments relate to a roofing shingle. In some embodiments, the roofing shingle comprises a top sheet. In some embodiments, the top sheet comprises a headlap. In some embodiments, the top sheet comprises a plurality of tabs extending from a side of the headlap. In some embodiments, the roofing shingle comprises a back sheet attached to the top sheet. In some embodiments, the back sheet underlies the plurality of tabs such that the back sheet has an exposed front surface between each of the plurality of tabs. In some embodiments, the exposed front surface of the back sheet has an upper portion. In some embodiments, the exposed front surface of the back sheet has a lower portion. In some embodiments, the exposed front surface of the back sheet has an intermediate portion between the upper portion and the lower portion. In some embodiments, the back sheet comprises a first plurality of granules having a first color. In some embodiments, the back sheet comprises a second plurality of granules having a second color. In some embodiments, the first plurality of granules is located in the upper portion and the lower portion of the exposed front surface of the back sheet. In some embodiments, the second plurality of granules is located in the intermediate portion of the exposed front surface of the back sheet. In some embodiments, the first color is darker than the second color.

In some embodiments, the upper portion of the exposed front surface of the back sheet has a width of 0.0625 inches to 0.5 inches.

In some embodiments, the lower portion of the exposed front surface of the back sheet has a width of 0.0625 inches to 0.5 inches.

In some embodiments, the first plurality of granules is not located in the intermediate portion of the exposed front surface of the back sheet.

In some embodiments, the top sheet comprises a third plurality of granules having a third color. In some embodiments, the first color is darker than the third color.

In some embodiments, the third plurality of granules is located on the plurality of tabs of the top sheet.

In some embodiments, the second color is different from the third color.

Some embodiments relate to a system. In some embodiments, the system comprises a roofing substrate. In some embodiments, the system comprises a plurality of roofing shingles located on the roofing substrate. In some embodiments, each of the plurality of roofing shingles comprises a top sheet. In some embodiments, the top sheet comprises a headlap. In some embodiments, the top sheet comprises a plurality of tabs extending from a side of the headlap. In some embodiments, each of the plurality of roofing shingles comprises a back sheet attached to the top sheet. In some embodiments, the back sheet underlies the plurality of tabs such that the back sheet has an exposed front surface between each of the plurality of tabs. In some embodiments, the exposed front surface of the back sheet has an upper portion. In some embodiments, the exposed front surface of the back sheet has a lower portion. In some embodiments, the exposed front surface of the back sheet has an intermediate portion between the upper portion and the lower portion. In some embodiments, the back sheet comprises a first plurality of granules having a first color. In some embodiments, the back sheet comprises a second plurality of granules having a second color. In some embodiments, the first plurality of granules is located in the upper portion and the lower portion of the exposed front surface of the back sheet. In some embodiments, the second plurality of granules is located in the intermediate portion of the exposed front surface of the back sheet. In some embodiments, the first color is darker than the second color.

In some embodiments, the upper portion of the exposed front surface of the back sheet has a width of 0.0625 inches to 0.5 inches.

In some embodiments, the lower portion of the exposed front surface of the back sheet has a width of 0.0625 inches to 0.5 inches.

In some embodiments, the first plurality of granules is not located in the intermediate portion of the exposed front surface of the back sheet.

In some embodiments, the top sheet comprises a third plurality of granules having a third color. In some embodiments, the first color is darker than the third color.

In some embodiments, the first color is darker than the third color.

In some embodiments, the second color is different from the third color.

In some embodiments, the roofing substrate comprises at least one of a roof deck, an underlayment, or any combination thereof.

Some embodiments relate to a stack. In some embodiments, the stack comprises a plurality of roofing shingles. In some embodiments, each of the plurality of roofing shingles comprises a top sheet. In some embodiments, the top sheet comprises a headlap. In some embodiments, the top sheet comprises a plurality of tabs extending from a side of the headlap. In some embodiments, each of the plurality of roofing shingles comprises a back sheet attached to the top sheet. In some embodiments, the back sheet underlies the plurality of tabs such that the back sheet has an exposed front surface between each of the plurality of tabs. In some embodiments, the exposed front surface of the back sheet has an upper portion. In some embodiments, the exposed front surface of the back sheet has a lower portion. In some embodiments, the exposed front surface of the back sheet has an intermediate portion between the upper portion and the lower portion. In some embodiments, the back sheet comprises a first plurality of granules having a first color. In some embodiments, the back sheet comprises a second plurality of granules having a second color. In some embodiments, the first plurality of granules is located in the upper portion and the lower portion of the exposed front surface of the back sheet. In some embodiments, the second plurality of granules is located in the intermediate portion of the exposed front surface of the back sheet. In some embodiments, the first color is darker than the second color.

In some embodiments, the upper portion of the exposed front surface of the back sheet has a width of 0.0625 inches to 0.5 inches.

In some embodiments, the lower portion of the exposed front surface of the back sheet has a width of 0.0625 inches to 0.5 inches.

In some embodiments, the first plurality of granules is not located in the intermediate portion of the exposed front surface of the back sheet.

In some embodiments, the top sheet comprises a third plurality of granules having a third color. In some embodiments, the first color is darker than the third color.

BRIEF DESCRIPTION OF DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein, and which are not to be construed as limiting to the scope of the present disclosure disclosed herein. No attempt is made to show structural details of this disclosure in more detail than may be necessary for a fundamental understanding of the exemplary embodiments discussed herein and the various ways in which they may be practiced.

DETAILED DESCRIPTION

Figure 1:
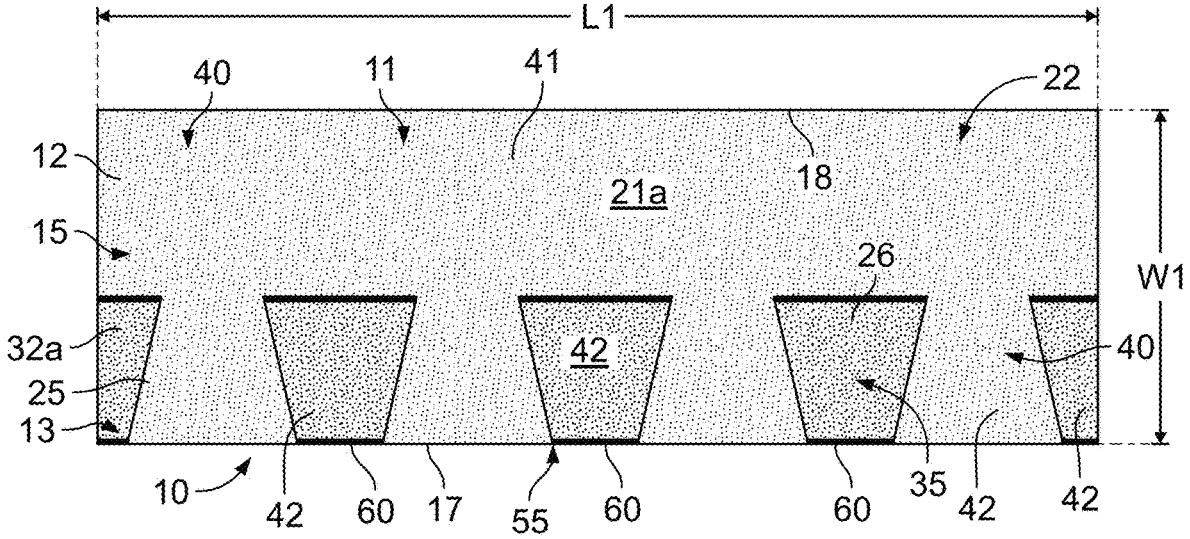
FIG. 1 is a perspective view illustrating an exemplary embodiment of a roofing shingle according to the principles of the present disclosure.

The following description in combination with the figures is provided to assist in understanding the embodiments and principles disclosed herein, and should not be interpreted as a limitation on the scope or applicability thereof. FIGS. 1-8B illustrate various embodiments of roofing shingles and roofing systems incorporating such roofing shingles in accordance with the principles of the present disclosure.

As used herein, the terms "comprises," "comprising," "includes," "including," "has," "having," or any other variation thereof, and are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive- or and not to an exclusive-or. For example, a condition A or B is satisfied by any one of the following: A is true (or present) and B is false (or not present), A is false (or not present) and B is true (or present), and both A and B are true (or present).

Dimensional information in the following description should be understood as nominal dimensions that are intended to encompass variations in dimensions that normally occur in the commercial production of laminated asphalt composition roofing shingles. Terms such as "approximately," "about," and "substantially" may be used to qualify dimensional information in the following description but such qualifications are intended merely to reinforce that the dimensions are nominal dimensions and not to differentiate qualified dimensions from unqualified dimensions. It will be recognized that roofing shingles are not precision parts and that substantial variations in dimensions can occur between nominally identical roofing shingles without affecting their function or usability.

The terminology used herein is for the purpose of description only and is not intended to be limiting of the present disclosure. Spatially relative terms, such as "beneath," "below," "lower," "above," "upper," and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below", or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a," "an," and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

Aspects of the drawings include different shading of one or more layers or portions of the roofing shingles of the present disclosure, which is not intended to signify particular color but only to indicate color contrasts between layers or along the same layer. The shading is optional and does not need to be applied. Further, reference to fines and granules includes different types, colors, tints, hues, or combinations thereof and is not limited to particular arrangement or application of granules.

In various embodiments of the present disclosure, roofing shingles 10 (FIGS. 1-8B) having various aesthetic effects, designs or features, such as an appearance of variable thickness and/or depth, multiple layers, simulated tabs or gaps, the appearance of other types of roofing materials such as other types of roofing shingles, wooden shakes, tiles, slate roofing materials, and combinations thereof, roofing systems (FIGS. 6 and 8A-8B) including such roofing shingles and methods of manufacturing such roofing shingles are discussed.

Figure 4A:
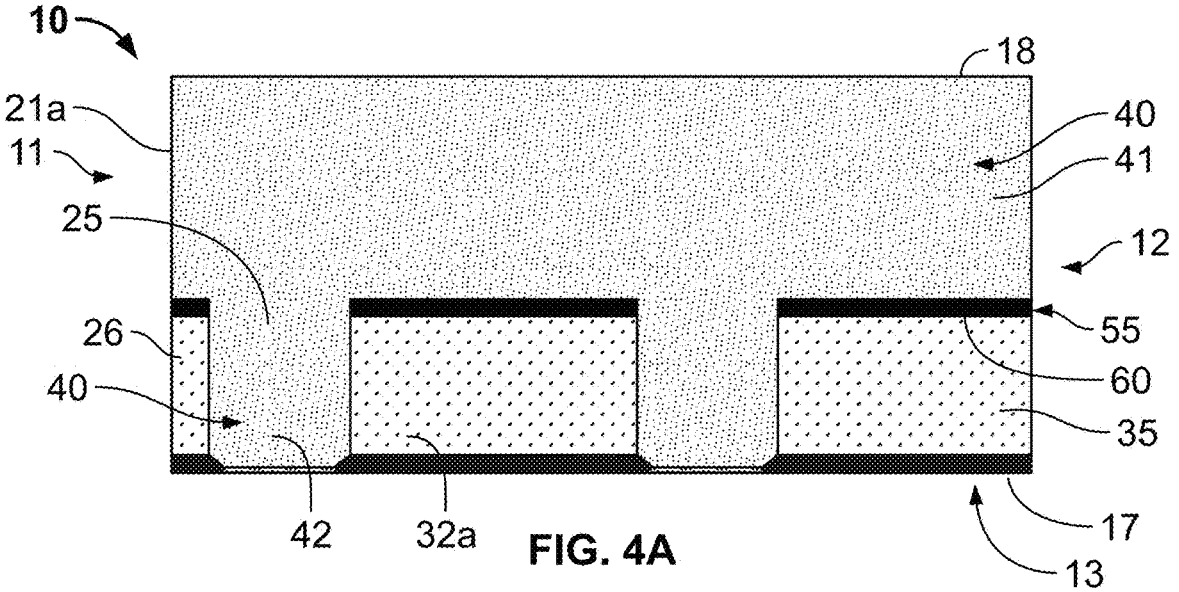
FIG. 4A is a top plan view illustrating an additional example embodiment of a first layer of a roofing shingle according to the principles of the present disclosure.
Figure 5:
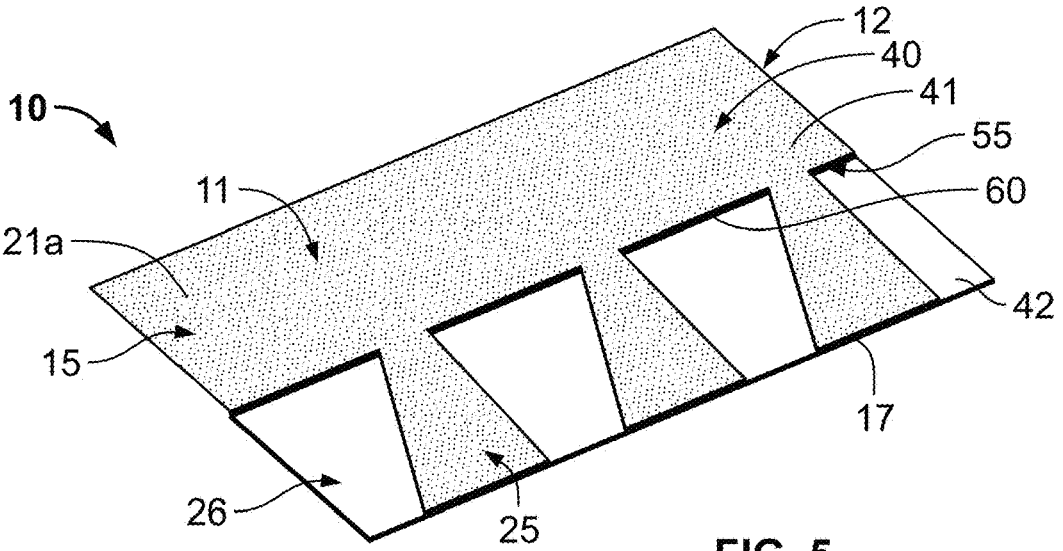
FIG. 5 is a top plan view illustrating an embodiment of a roofing shingle according to the principles of the present disclosure.
Figure 6:
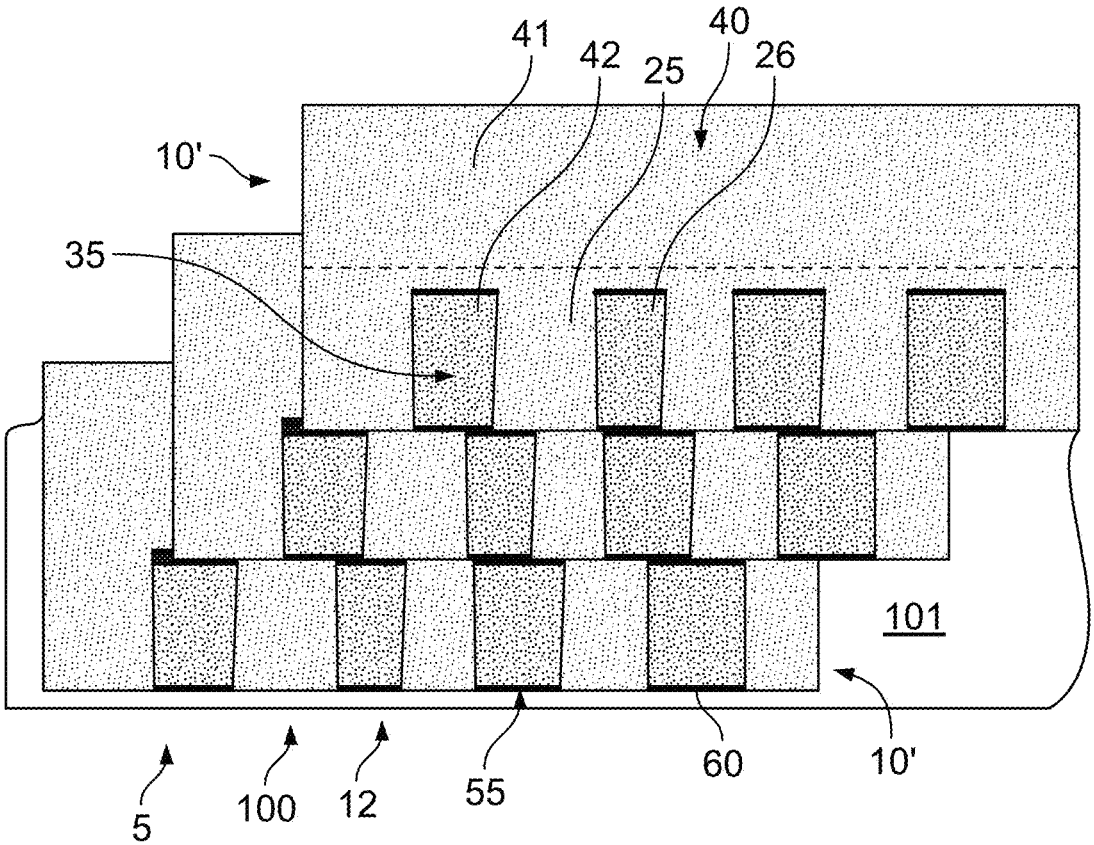
FIG. 6 is a top plan view of an example embodiment of a plurality of roofing shingles such as shown in FIGS. 1-2 according to the principles of the present disclosure.

For example, in some embodiments such as shown in FIGS. 1-4B, the roofing shingles 10 can comprise multi-layer (e.g., two or more layers) laminated roofing shingles, which can include at least a top sheet, and a back sheet attached to the top sheet, and can be configured with one or more shading areas defining shadow lines adapted to create various aesthetic features along the roofing shingles. In addition, in some other embodiments, the roofing shingles can comprise more than two layers. In other embodiments, such as shown in FIGS. 5-6, the roofing shingles 10' can comprise a strip shingle having a single layer of shingle material including one or more shading areas defining shadow lines configured to create one or more aesthetic features along the roofing shingles.

For example, in embodiments, such aesthetic features can be created along the top surfaces of the roofing shingles 10/10', and can include, without limitation, an appearance of increased depth or thickness that can be configured to simulate multiple layers of shingle materials, to simulate tabs, gaps, or other design features, to provide an appearance of different types of roofing materials, such as more expensive roofing shingles, wooden shakes, tiles, slate roofing materials, or combinations thereof. Other aesthetic features also can be provided.

In embodiments, the roofing shingles can be provided with one or more shading areas located along a top surface of the roofing shingles, the top surface being a surface of the roofing shingles exposed to weather, such as rain, snow, wind, ultraviolent (UV) light, while a bottom surface of the roofing shingles generally can comprise a lower surface of the roofing shingles facing the roof deck of a roof along which the roofing shingles are applied. In various embodiments, the shading areas can be formed along the one or more layers of the roofing shingles, and can be formed from granules, fines or other particulate materials, or, in some embodiments, paint or other colorant materials, which can be applied at selected areas of the shingles. For example, in some embodiments, the one or more shading areas can be defined along areas of transition between the first layer and the second layer or between simulated headlap and exposure portions defined along a top surface of a single layer or strip shingle; and can be configured to provide color transitions between different color granules, such as between different color of types of granules used for headlap and exposure portions of the roofing shingles.

In embodiments, the one or more shading areas can define one or more shadow lines along the top surface of the roofing shingles. For example, in embodiments, dual shadow lines can be provided, and can include intermittent or substantially continuous lines, dashes, or stripes of selected thickness or width extending along a length of each roofing shingle. The dual shadow lines areas can be formed along areas corresponding to a top edge or upper portion and a bottom edge or lower portion of gaps between teeth or tabs formed by the application of multiple layers, i.e. the exposed front surface of the back sheet, of shingle materials for laminated shingles, or along top edges or upper portions and bottom edges and lower portions of simulated gaps between simulated tabs or teeth of a single layer of shingle material such as for strip shingles.

In embodiments, the one or more shadow lines can be configured to simulate various aesthetic features and/or create a desired visual appearance. For example, the one or more shadow lines can be configured to create an appearance or illusion of increased thickness or depth to the roofing shingles, to create and appearance of multiple layers, to simulate features such as tabs or teeth, to provide an appearance of more expensive roofing materials, including roofing shingles, wood shakes, tiles, slate or other roofing materials, to create more recognizable areas of transition between headlap and exposure portions or between layers of the roofing shingles, or combinations thereof.

In embodiments, roofing systems 5 (FIG. 6) formed according to the principles of the present disclosure can be used for construction of a roof R for commercial and residential applications. For example, in embodiments, the roofing systems can be configured to form a low slope roof, including a roof having a slope or pitch of Y/X, where Y corresponds to the "rise" of the roof, and where X corresponds to the "run" of the roof. In embodiments, the roof can have a pitch or slope where Y and X are in a ratio of less 4:12. In some embodiments, Y and X are in a ratio of less than 3:12. In some embodiments, Y and X are in a ratio of less than 2:12. In some embodiments, Y and X are in a ratio of less than 1:12. In some embodiments, Y and X are in a ratio of 1:12 to 3:12.

In other embodiments, the roofing system can be configured to form a roof having a slope of greater than a ratio of 4:12. For example, the roof can have a pitch or slope where Y and X are in a ratio of 4:12 to 12:12. In some embodiments, Y and X are in a ratio of 5:12 to 12:12. In some embodiments, Y and X are in a ratio of 6:12 to 12:12. In some embodiments, Y and X are in a ratio of 7:12 to 12:12. In some embodiments, Y and X are in a ratio of 8:12 to 12:12. In some embodiments, Y and X are in a ratio of 9:12 to 12:12. In some embodiments, Y and X are in a ratio of 10:12 to 12:12. In some embodiments, Y and X are in a ratio of 11:12 to 12:12.

Embodiments of a roofing shingle 10 and roofing systems 100 incorporating such roofing shingles 10 according to the present disclosure are shown in FIGS. 1-8B. In embodiments, the roofing shingles comprise at least one layer of a shingle material, which, in some example embodiments, can comprise a mat formed from a fibrous material such as an organic felt or fiberglass mat and coated or impregnated with a coating, which, in embodiments, can include asphalt materials and/or modified bituminous coatings. Other shingle materials also can be used. In some embodiments, such as shown in FIGS. 1-4B, the roofing shingles 10 can comprise multi-layer roofing shingles (e.g., two layer laminated roofing shingles having a first or upper layer and a second or lower layer).

Figure 2A:
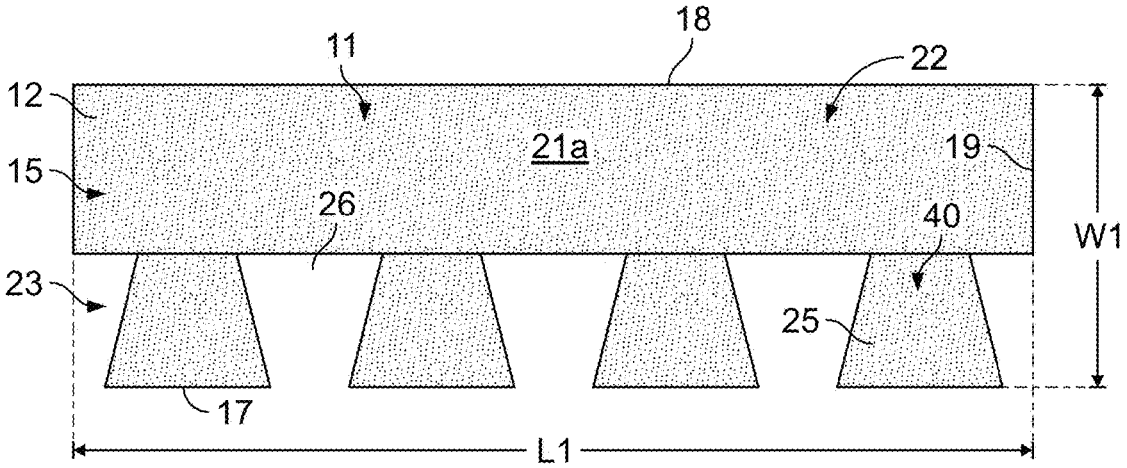
FIG. 2A is a top plan view illustrating an example embodiment of a first layer of a roofing shingle such as shown in FIG. 1.
Figure 2B:
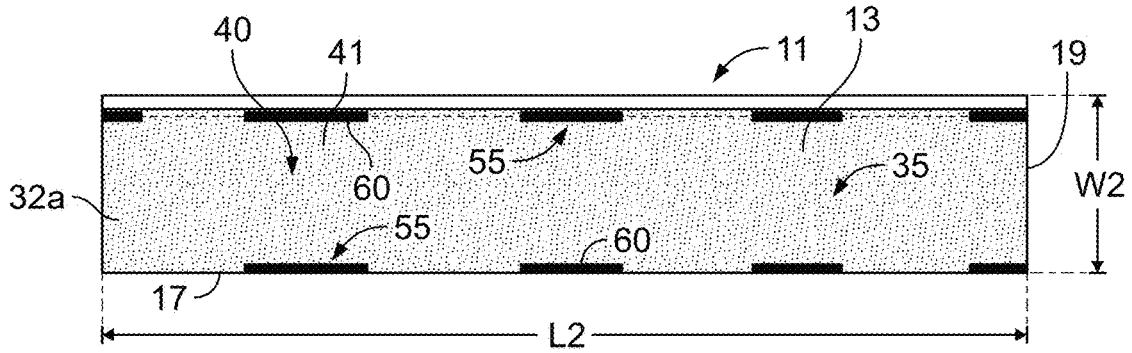
FIG. 2B is a bottom plan view an example embodiment of a second layer of a roofing shingle such as shown in FIG. 1.
Figure 2C:
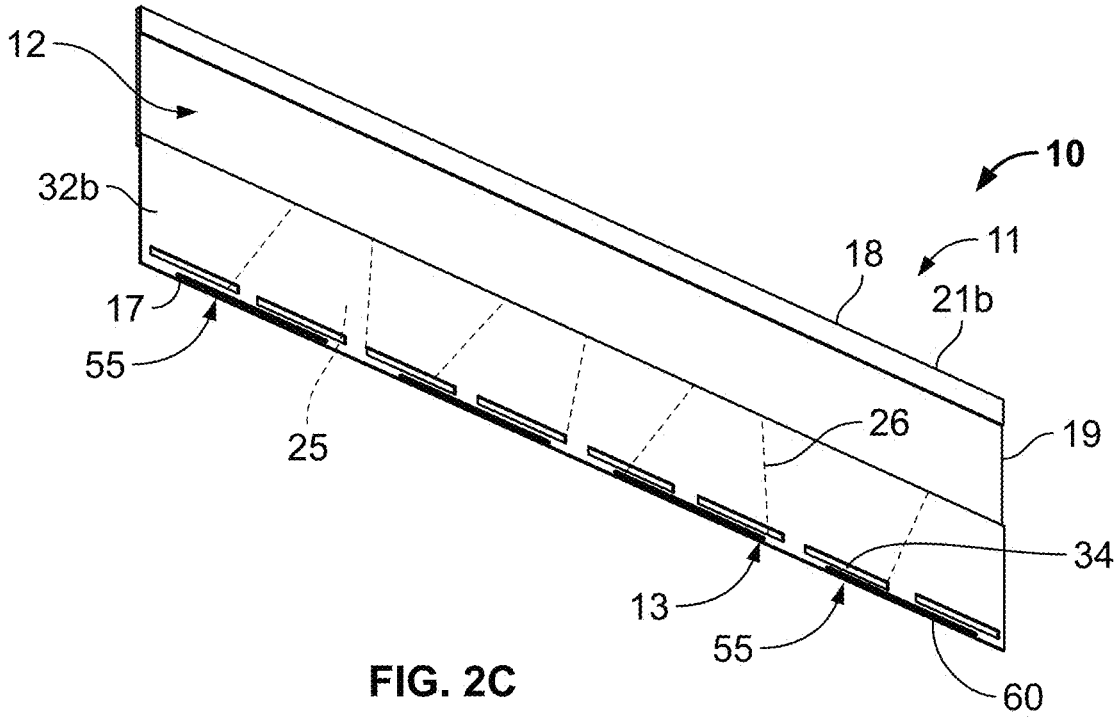
FIG. 2C is a perspective view illustrating a bottom surface the exemplary embodiment of the roofing shingle depicted in FIG. 1.

FIGS. 1-2C illustrate an example embodiment of a roofing shingle 10, which includes a shingle body 11 having a top surface 15 (FIGS. 1 and 2A), a bottom surface (FIG. 2C)

a first or front edge 17, a second or rear edge 18, and side edges 19. In some embodiments, the body 11 can comprise a single layer of shingle material (e.g., a strip shingle such as indicated in FIGS. 5-6); while, in other embodiments, such as shown in FIGS. 1-4B, the roofing shingle 10 can comprise a two layer shingle, laminated shingle, that can include a top sheet 12 and a back sheet 13. In embodiments, such as shown in FIGS. 7A-8B, the roofing shingles 10 can be installed along a roof deck or substrate of a roof in a plurality of courses, with the roofing shingles of a higher course of roofing shingles overlapping at least a portion of the roofing shingles of a lower course of roofing shingles.

In embodiments, the layer of shingle material (e.g., a single layer of shingle material as shown in FIG. 5 or the top sheet 12 of a multi-layer roofing shingle as shown in FIGS. 1-2A, 3 and 4A) can have a length (L1) of 20 inches to 50 inches; and in embodiments, can have a length (L1) of 20 inches to 45 inches; 20 inches to 40 inches, 20 inches to 35 inches; 20 inches to 30 inches; 20 inches to 25 inches; 25 inches to 50 inches; 25 inches to 45 inches; 25 inches to 40 inches; 25 inches to 35 inches; 25 inches to 30 inches; 30 inches to 50 inches; 30 inches to 45 inches; 30 inches to 40 inches; 40 inches to 50 inches; 40 inches to 45 inches; or 45 inches to 50 inches. Other lengths also can be provided.

In embodiments, the at least one layer (e.g., the top sheet) of the roofing shingle 10 can further have a width (W1) of 10 inches to 20 inches. Other widths also can be provided.

As further illustrated in the example embodiments shown in FIGS. 1, 2A, 3 and 4A, the top sheet 12 of the roofing shingle 10 can include an upper surface 21*a* that forms at least a portion of the top surface 15 of the roofing shingle and a lower surface 21*b* opposite its upper surface 21*a* that can form at least part of the bottom surface of the roofing shingle. In embodiments, the upper surface of the top sheet 12 further can include a headlap 22 and a plurality of tabs 23 extending from a side of the headlap 22.

In embodiments, the headlap 22 can extend from the rear edge 18 of the roofing shingle 10 at least partially across the width (W1) of the roofing shingle 10 toward the front edge 17 thereof. In addition, the plurality of tabs 23 extend from the headlap 22 to the front edge 17 of the roofing shingle 10, and in embodiments, an area of transition 20 can be defined therebetween. In embodiments, when installed on as part of a roofing system including a plurality of courses of roofing shingles, will overlap and substantially cover the headlap portion of one or more roofing shingles of a lower course of roofing shingles.

In embodiments, such as shown in FIGS. 1, 2A, 3 and 4A, the plurality of tabs 23 are separated by one or more openings or gaps 26. While the Figures of the present disclosure illustrate the use of various numbers of tabs 25, it will be understood that greater or lesser numbers of such tabs 25 and gaps 26 can be utilized. For example, in some embodiments, such shown in FIG. 4A, fewer tabs 25 can be formed in the top sheet 12 with shading areas defined along the gaps 26 between the tabs 25 and including a plurality of granules or fines forming one or more shadow lines to create an appearance of simulated tabs 25.

Figure 3:
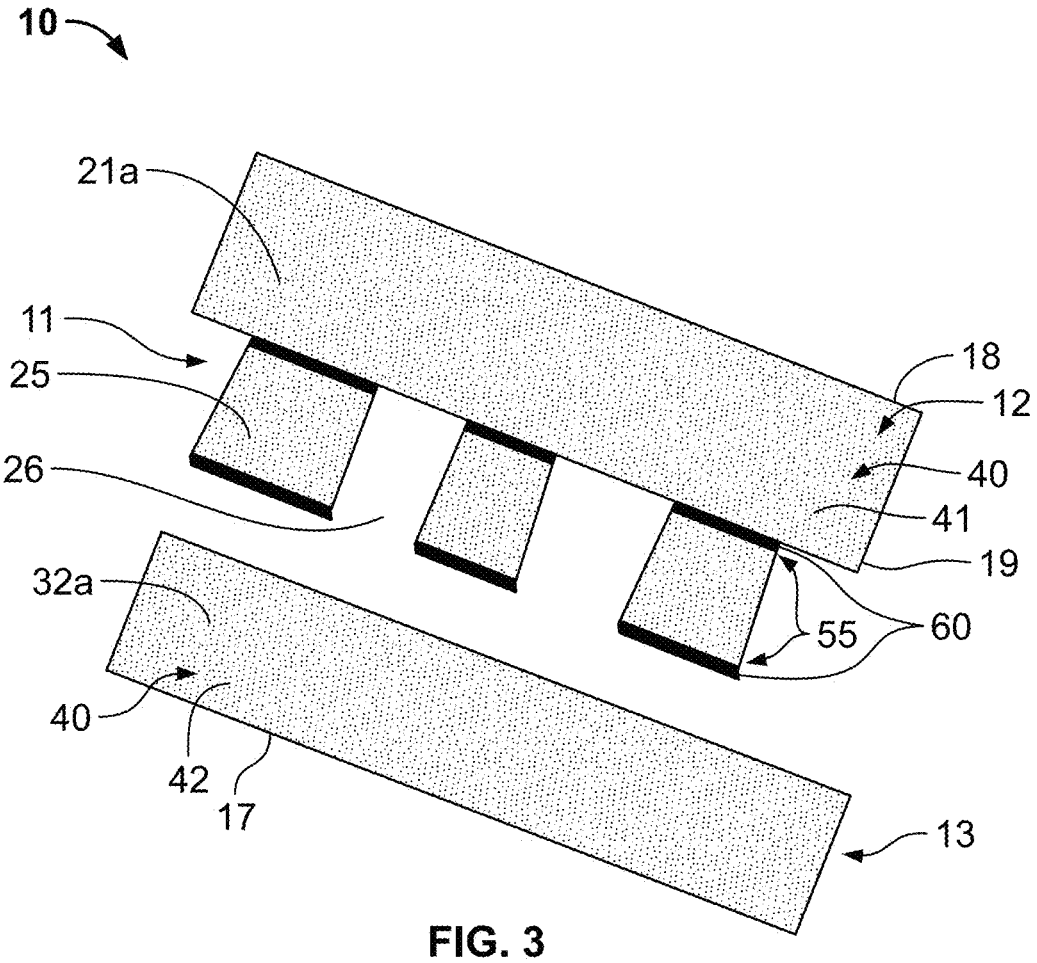
FIG. 3 is a top plan view illustrating an additional example embodiment of a roofing shingle according to the principles of the present disclosure.

In addition, in embodiments, the plurality of tabs 23 can include tabs 25 and gaps 26 of varying sizes and also can include tabs 25 and gaps 26 having various configurations. In some embodiments, the roofing shingles 10 can have one or more full sized tabs 25 and gaps 26 (e.g., as illustrated in FIGS. 1-2A and 5). In other embodiments, the roofing shingles 10 could be configured with one or more partial tabs 25, and the gaps 26 between each of the tabs can be expanded, (e.g., as illustrated in FIGS. 3 and 4A). Still further, the tabs 25 can be formed with varying configurations, including being substantially rectangular, including rectangular tabs with beveled or substantially flat front edges, such as shown in FIGS. 3 and 4A, while in other embodiments, the tabs 25 can be formed with a substantially trapezoidal, triangular, jagged, or other configuration (e.g., having a configuration of "dragon teeth"), such as shown in FIGS. 1-2A and 5.

As illustrated in FIGS. 1, 2B and 2C, the bottom sheet 13 can be formed from a shingle material and can have a length L2 and a width W2. In embodiments, the length L2 of the bottom sheet 13 can be substantially equivalent to the length L1 of the top sheet 12, while the width W2 of the bottom sheet 13 can be less than the width W1 of the top sheet 12. For example, in embodiments, the bottom sheet 13 can have a width of 6 inches to 15 inches, and in some embodiments, can have a width of 6 inches to 14 inches, 6 inches to 13 inches, 6 inches to 12 inches, 6 inches to 11 inches, 6 inches to 10 inches, 6 inches to 9 inches, 6 inches to 8 inches, 6 inches to 7 inches, 7 inches to 15 inches, 7 inches to 14 inches, 7 inches to 13 inches, 7 inches to 12 inches, 7 inches to 11 inches, 7 inches to 10 inches, 7 inches to 9 inches, 7 inches to 8 inches, 8 inches to 15 inches, 8 inches to 14 inches, 8 inches to 13 inches, 8 inches to 12 inches, 8 inches to 11 inches, 8 inches to 10 inches, 8 inches to 9 inches, 9 inches to 15 inches, 9 inches to 14 inches, 9 inches to 13 inches, 9 inches to 12 inches, 9 inches to 11 inches, 9 inches to 10 inches, 10 inches to 15 inches, 10 inches to 14 inches, 10 inches to 13 inches, 10 inches to 12 inches, 10 inches to 11 inches, 11 inches to 15 inches, 11 inches to 14 inches, 11 inches to 13 inches, 11 inches to 12 inches, 12 inches to 15 inches, 12 inches to 14 inches, 12 inches to 13 inches, 13 inches to 15 inches, 13 inches to 14 inches, or 14 inches to 15 inches. Other widths also can be provided.

In embodiments, as indicated in FIGS. 2B-2C, the bottom sheet 13 can have an upper surface 32*a* that can be attached to a lower surface 21*b* of the top sheet 12, and can have a lower surface 32*b* that defines part of a bottom surface 33 of the roofing shingle 10. In embodiments, the upper surface 32*a* of the bottom sheet 13 can be attached to the lower surface 21*b* of the top sheet 12, such as by adhesives, to form a 2-layer laminated roofing shingle 10. As indicated in FIG. 2C, the bottom sheet 13 generally will be aligned with the plurality of tabs 23 of the top sheet 12, with the lower surface of the bottom sheet 13 defining at least a portion of the bottom side or surface of the roofing shingle 10. Further, in embodiments, a sealant material 34 can be applied to the lower surface 32*b* adjacent a front or forward end thereof. The sealant material can be applied as lines, stripes, dashes, dots or combinations thereof and can comprise a self-seal material.

In embodiments, as illustrated in FIG. 1, the back sheet 13 underlies the plurality of tabs 23 of the top sheet 12 such that the back sheet 13 has an exposed front surface 35 between each of the plurality of tabs 23. This exposed front surface 35 of the back sheet 13 will be exposed to the outdoor environment. As illustrated in FIGS. 3 and 4A, the size of the exposed front surface 35 of the back layer 13 can be varied depending on the size of the gaps 26 formed between the tabs 25 of the top sheet 12. In some embodiments, the exposed front surface 35 of the back sheet 12 has an upper portion, a lower portion, and an intermediate portion between the upper portion and the lower portion. In some embodiments, the lower portion is located adjacent the front edge 17 of the back sheet 13 and the upper portion is located adjacent the transition between the top sheet 12 and the back sheet 13.

In some embodiments, the upper portion of the exposed front surface 35 of the back sheet 13 has a width of from about 1/16 inch to about 1½ inch, and in some embodiments, the upper portion of the exposed front surface 35 has a width of 1/16 inch to 1⅜ inch, 1/16 inch to 1¼ inch, 1/16 inch to 1 inch, 1/16 inch to ⅞ inch, 1/16 inch to ¾ inch, 1/16 inch to ⅝ inch, 1/16 inch to ½ inch, 1/16 inch to ⅜ inch, 1/16 inch to ¼ inch, 1/16 inch to ⅛ inch, ⅛ inch to 1½ inch, ⅛ inch to 1⅜ inch, ⅛ inch to 1¼ inch, ⅛ inch to 1 inch, ⅛ inch to ⅞ inch, ⅛ inch to ¾ inch, ⅛ inch to ⅝ inch, ⅛ inch to ½ inch, ⅛ inch to ⅜ inch, ⅛ inch to ¼ inch, ¼ inch to 1½ inch, ¼ inch to 1⅜ inch, ¼ inch to 1¼ inch, ¼ inch to 1 inch, ¼ inch to ⅞ inch, ¼ inch to ¾ inch, ¼ inch to ⅝ inch, ⅛ inch to ½ inch, ¼ inch to ⅜ inch, ⅜ inch to 1½ inch, ⅜ inch to 1⅜ inch, ⅜ inch to 1¼ inch, ⅜ inch to 1 inch, ⅜ inch to ⅞ inch, ⅜ inch to ¾ inch, ⅜ inch to ⅝ inch, ⅜ inch to ½ inch, ½ inch to 1½ inch, ½ inch to 1⅜ inch, ½ inch to 1¼ inch, ½ inch to 1 inch, ½ inch to ⅞ inch, ½ inch to ¾ inch, ½ inch to ⅝ inch, ⅝ inch to 1½ inch, ⅝ inch to 1⅜ inch, ⅝ inch to 1¼ inch, ⅝ inch to 1 inch, ⅝ inch to ⅞ inch, ⅝ inch to ¾ inch, ¾ inch to 1½ inch, ¾ inch to 1⅜ inch, ¾ inch to 1¼ inch, ¾ inch to 1 inch, ¾ inch to ⅞ inch, ⅞ inch to 1½ inch, ⅞ inch to 1⅜ inch, ⅞ inch to 1¼ inch, ⅞ inch to 1 inch, 1 inch to 1½ inch, 1 inch to 1⅜ inch, 1 inch to 1¼ inch, 1¼ inch to 1½ inch, 1¼ inch to 1⅜ inch, or 1⅜ inch to 1½ inch.

In some embodiments, the lower portion of the exposed front surface 35 of the back sheet 13 has a width of from about 1/16 inch to about 1½ inch, and in some embodiments, the lower portion of the exposed front surface 35 has a width of 1/16 inch to 1⅜ inch, 1/16 inch to 1¼ inch, 1/16 inch to 1 inch, 1/16 inch to ⅞ inch, 1/16 inch to ¾ inch, 1/16 inch to ⅝ inch, 1/16 inch to ½ inch, 1/16 inch to ⅜ inch, 1/16 inch to ¼ inch, 1/16 inch to ⅛ inch, ⅛ inch to 1½ inch, ⅛ inch to 1⅜ inch, ⅛ inch to 1¼ inch, ⅛ inch to 1 inch, ⅛ inch to ⅞ inch, ⅛ inch to ¾ inch, ⅛ inch to ⅝ inch, ⅛ inch to ½ inch, ⅛ inch to ⅜ inch, ⅛ inch to ¼ inch, ¼ inch to 1½ inch, ¼ inch to 1⅜ inch, ¼ inch to 1¼ inch, ¼ inch to 1 inch, ¼ inch to ⅞ inch, ¼ inch to ¾ inch, ¼ inch to ⅝ inch, ⅛ inch to ½ inch, ¼ inch to ⅜ inch, ⅜ inch to 1½ inch, ⅜ inch to 1⅜ inch, ⅜ inch to 1¼ inch, ⅜ inch to 1 inch, ⅜ inch to ⅞ inch, ⅜ inch to ¾ inch, ⅜ inch to ⅝ inch, ⅜ inch to ½ inch, ½ inch to 1½ inch, ½ inch to 1⅜ inch, ½ inch to 1¼ inch, ½ inch to 1 inch, ½ inch to ⅞ inch, ½ inch to ¾ inch, ½ inch to ⅝ inch, ⅝ inch to 1½ inch, ⅝ inch to 1⅜ inch, ⅝ inch to 1¼ inch, ⅝ inch to 1 inch, ⅝ inch to ⅞ inch, ⅝ inch to ¾ inch, ¾ inch to 1½ inch, ¾ inch to 1⅜ inch, ¾ inch to 1¼ inch, ¾ inch to 1 inch, ¾ inch to ⅞ inch, ⅞ inch to 1½ inch, ⅞ inch to 1⅜ inch, ⅞ inch to 1¼ inch, ⅞ inch to 1 inch, 1 inch to 1½ inch, 1 inch to 1⅜ inch, 1 inch to 1¼ inch, 1¼ inch to 1½ inch, 1¼ inch to 1⅜ inch, or 1⅜ inch to 1½ inch.

Referring to FIGS. 1 and 3, in embodiments, the upper surface 21*a* of the top sheet 12 and the exposed front surface 35 of the back sheet 13 of the roofing shingle 10 define the top surface of the roofing shingle that will be configured to be exposed to an outdoor environment and weather. In embodiments, the upper surfaces 21*a*/32*a* of the top sheet 12 and the back sheet 13 will be coated with various types of roofing granules 40 to protect the asphalt coating against effects of weather, including ultraviolet light (UV) protection, rain, to add color to roofing shingle 10 of the disclosure, to provide fire resistance, and/or other properties. For example, in embodiments, the granules 40 can be applied to and embedded within a coating (e.g., asphalt) applied to the upper surface.

For example, in embodiments, the exposed front surface 35 of the back sheet 13 can include a first plurality of granules and a second plurality of granules. In some embodiments, the first plurality of granules is located in the upper portion and the lower portion of the exposed front surface 35 of the back sheet 13. In some embodiments, the second plurality of granules is located in the intermediate portion of the exposed front surface 35 of the back sheet 13. In some embodiments, the first plurality of granules have a first color. In some embodiments, the first color can be any color, for example and not limited to, black, gray, brown, blue, red, orange, purple, green, yellow, any tint thereof, any shade thereof, or any combination thereof. In some embodiments, the second plurality of granules have a second color. In some embodiments, the second color can be any color, for example and not limited to, black, white, gray, brown, blue, red, orange, purple, green, yellow, any tint thereof, any shade thereof, or any combination thereof. In some embodiments, the first color is darker than the second color.

In some embodiments, the top sheet 12 comprises a third plurality of granules. In some embodiments, the third plurality of granules is located on at least one of the headlap 22 of the top sheet 12, the plurality of tabs 23 of the top sheet 12, or any combination thereof. In some embodiments, the third plurality of granules have a third color. In some embodiments, the third color can be any color, for example and not limited to, black, white, gray, brown, blue, red, orange, purple, green, yellow, any tint thereof, any shade thereof, or any combination thereof. In some embodiments, the first color is darker than the third color. In some embodiments, the third color can be the same or different from the second color.

In some embodiments, the bottom surface of roofing shingle 10 may be coated with various inert minerals with sufficient consistency to seal the asphalt coating.

Figure 4B:
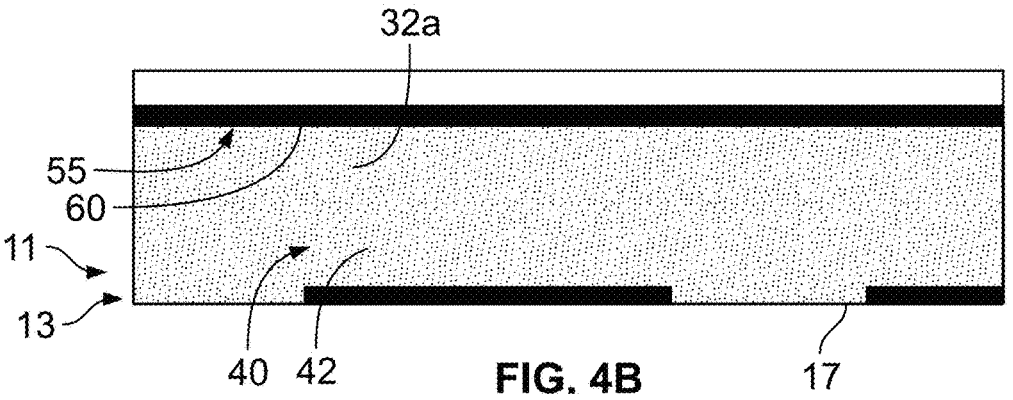
FIG. 4B is a bottom plan view an example embodiment of a second layer of a roofing shingle such as shown in FIG. 4.

FIGS. 3-4B illustrate additional embodiments of the roofing shingle 10. In these embodiments, the roofing shingle 10 includes two layers of a roofing shingle material, a top sheet 12 and a bottom sheet 13 that, in embodiments, can be laminated together to form the body 11 of the roofing shingle 10. FIGS. 3-4B illustrate embodiments wherein the plurality of tabs extending from the headlap of the top sheet 12 have an irregular configuration (e.g., here shown as teeth of differing widths and angled edges). Other configurations also can be used. In addition, as also shown in FIGS. 3-4A, the tabs 25 can be arranged at differing spacings, with the gaps 26 therebetween being of different sizes.

FIGS. 5 and 6 illustrate an additional embodiment of a roofing shingle 10', and an example installation thereof along a roof according to the principles of the present disclosure. In the embodiment illustrated in FIGS. 5 and 6, the roofing shingle 10' is shown as a strip roofing shingle having a body 11 that comprises a single layer of a roofing shingle material. The body 11 of the roofing shingle 10' generally will comprise upper surface 21*a* that defines a top surface 15 of the roofing shingle 10 which will be exposed to outdoor conditions (e.g., weather), a lower or bottom surface adapted to be positioned over a roof deck or a membrane applied to the roof deck, and a plurality of peripheral edges, including a front edge 17, rear edge 18 and opposed side edges 19.

In embodiments, a plurality of granules 40 can be applied to the upper surface 21 of the body, being applied to and/or embedded in a coating (e.g., an asphalt material other coating) applied along the upper surface, to protect the coating against effects of weather, including ultraviolet light (UV) protection, rain, provide fire resistance, and/or other properties and combinations thereof, as well as to add color to roofing shingle 10'. In embodiments, the plurality of granules 40 can comprise one or more different granules, which can differ in type, size, color or other properties. For example, in embodiments, the plurality of granules 40 can include a first plurality of granules, which can comprise headlap granules 41 applied to a portion of the upper surface 21*a* so as to define a headlap of the roofing shingle 10' along the upper surface 21*a*. The plurality of granules further can include a second plurality of granules, which can include butt granules 42 applied to an adjacent portion of the upper surface so as to define an exposure portion of the roofing shingle 10'.

In addition, as further illustrated in FIG. 5, the exposure portion of the roofing shingle 10' can be formed with an appearance of tabs 25 with gaps 26 therebetween. For example, in embodiment, the second plurality of granules can include sequential applications of different or types or colors, tints, hues, or shades of granules along different sections of the exposure portion. In other embodiments, the butt granules 41 can include two or more different types or colors of granules, which can be applied in patches or discrete applications along the upper surface, e.g., an application of a base patch of a first color or type of butt granules 41 can be applied to the upper surface 23*a*, after which a second patch of a different color, tint, shade, or hue of butt granules 41 (e.g., different color or type granules) can be applied thereover to provide a contrast between the two sets of butt granules 41 to define the tabs 25 and gaps 26 along the upper surface.

In embodiments, the roofing shingles 10/10' further can include one or more shading areas 55 defined along the top surface of the roofing shingle. The shading areas 55 can comprise a plurality of granules, fines or other materials, and can be applied in various configurations and to selected locations along the top surface of the roofing shingle. In embodiments, such as illustrated in FIGS. 1 and 5, shading areas can define a plurality of shadow lines 60 along the top surface of the roofing shingles.

In some embodiments, such as where the roofing shingle comprises a multi-layer (e.g., two layer) laminated roofing shingle 10 (FIGS. 1 and 3), the one or more shading areas can be positioned along areas of transition between the top sheet 12 and the back sheet 13 of the roofing shingle 10, i.e. the upper portion of the exposed front surface of the back sheet 13, and along the upper surface of the back sheet 13 adjacent the front edge 17 of the roofing shingle 10, i.e. the lower portion of the exposed front surface of the back sheet 13. In other embodiments, the shading areas can be positioned between the headlap and the gaps 26 defined along a top surface of a single layer or strip roofing shingle 10' (FIG. 5), and/or along the front edge of the roofing shingle.

In embodiments, the one or more shading areas and/or shadow lines can be configured to simulate various aesthetic features and/or create a desired visual appearance. For example, the shadow lines can be configured as areas of separation between layers/sheets and/or adjacent roofing shingles, so as to create an appearance or impression of increased thickness or depth to the roofing shingles and/or an appearance of multiple layers as illustrated in FIGS. 1 and 3, and in some embodiments further can be configured to simulate features such as tabs and gaps and provide an impression of multiple layers and depth such as for strip shingles installed along a roof deck as illustrated in FIG. 6. In addition, in some embodiments, the shadow lines further can be to provide an appearance of different types of roofing materials, such as premium or more expensive roofing shingles, wood shakes, tiles, slate or other roofing materials, to create more recognizable areas of transition between adjacent roofing shingles of higher and lower courses of roofing shingles installed along a roof deck, between headlap and the plurality of tabs, or between layers/sheets of the roofing shingles, or combinations thereof.

In various embodiments, the shadow lines 60 will have a different appearance from the granules 40 applied along the layers/sheets of the roofing shingles 10/101. For example, in embodiments, the shadow lines 60 can be darker in appearance as compared to the headlap and butt granules 41/42 or of the roofing shingles, to provide a contrasting appearance configured to create the impression of bulk, increased thickness, depth, multiple layers, or combinations thereof, which can provide a visual appearance the roofing single having multiple layers and/or multiple layers of increased thickness. In embodiments, the first plurality of granules form the shadow lines 60. In some embodiments, the shadow lines 60 comprise the first plurality of granules. In some embodiments, the headlap granules 41 and the butt granules 42 comprise at least one of the second plurality of granules, the third plurality of granules, or any combination thereof.

In embodiments, the roofing shingles can include dual shadow lines formed at spaced positions across a width of the roofing shingle, and can extend substantially along the length of the roofing shingle. In embodiments, dual shadow lines 60 can be formed along the upper surfaces of one or more layers/sheets of each roofing shingle by intermittent or substantially continuous applications of fines or granules, with the shadow lines generally being positioned adjacent an area of transition between the headlap and gaps of the roofing shingles and adjacent the front edges of the roofing shingles.

For example, in embodiments, such as where the roofing shingle 10 (FIG. 1) comprises a multi-layer laminated roofing shingle, the fines or granules (first plurality of granules) of the dual shadow lines 60 can be applied to the upper surface 32*a* (FIGS. 2B and 4B) of the back sheet 13 of shingle material. The fines or granules (first plurality of granules) of the dual shadow lines can be applied to the upper surface 32*a* of the back sheet 13, in intermittent or substantially continuous lines, stripes, dashes, or patches of varying amounts, thicknesses, and/or widths, that will be visible along the exposed front surfaces 35 of the upper surface 32*a*, e.g., along a first or top edge of each gap 26 adjacent an area of transition between the headlap of the top sheet and the exposed front surface of the back sheet, i.e. the upper portion of the exposed front surface, and at a second or bottom edge of each gap, adjacent the front edge of the roofing shingle, i.e. the lower portion of the exposed front surface, as shown in FIGS. 1 and 3.

In other embodiments, such as illustrated in FIG. 3, one or more shadow lines 60 can be formed along portions of the tabs 25 of the upper layer 21 of the top sheet 12 of the roofing shingle 10. The shadow lines 60 can include a plurality of fines, granules or other colorant materials (first plurality of granules) to create shading areas 55 having a darker appearance from the other portions of the upper surface 21*a* of the top sheet and the exposed front surface 35 of the upper surface 32*a* of the back sheet 13. In addition, in embodiments, the shadow lines can include dual shadow lines that can be positioned along an upper portion of one or more of the tabs, for example, being formed along an area of transition between the headlap and plurality of tabs of the top sheet, and along a lower edge adjacent the front edge of the roofing shingle, which can be aligned with an edge of the back sheet, as illustrated in FIG. 3.

In other embodiments, the shadow lines can be positioned along both the upper surface of the top sheet and along the exposed front surface of the back sheet. In such embodiments, the shadow lines can be formed across selected portions of the tabs of the top sheet and/or the exposed front surface of the back sheet, and further can be spaced or alternated between the tabs and the exposed front surface, for example, with some shadow lines, such as an upper series of shadow lines positioned along the upper surface of the back sheet and adjacent the area of transition between the headlap and the exposed front surface, and the shadow lines adjacent the front edge of the roofing shingle being positioned along the upper surface of the top sheet. Other, alternative configurations also can be provided.

In still other embodiments, such as where the roofing shingle 10' (FIG. 5) comprises a single layer of shingle material, dual shadow lines 60 can be formed by applying fines or granules on top of the headlap and/or butt granules 41/42 (or at an area of transition between the headlap 22 and the plurality of tabs 23) applied to the upper or top surface of the roofing shingle. In embodiments, the shadow lines can be applied in substantially continuous lines, stripes, dashes, or patches, along the length of the second layer of a two layer shingle or the top surface of a single layer shingle, or in intermittent lines, stripes or patches, and further can be applied in varying amounts, thicknesses, and/or widths, so as to create a contrasting appearance that provides the impression of the shingle having multiple layers, and/or having increased thickness and depth between adjacent roofing shingles installed along a roof deck, or combinations thereof.

In some additional embodiments, the shadow lines could also include paint, dyes, or other colorants to help create a darker appearance of the shadow lines 60 that contrasts with the granules applied to the top surface of the roofing shingle, such as illustrated in FIGS. 1, 3 and 5. For example, in some embodiments, paint or dyes can be applied, without or in conjunction with fines or granules to create a contrast between the headlap and butt granules and along the front edge of roofing shingle and provide an the impression of the shingle having multiple layers and/or having an increased thickness and depth between adjacent roofing shingles installed along a roof deck.

In addition, in some embodiments, one or more of the dual shadow lines 60 can be positioned adjacent areas of transition between the headlap and the exposed front surface of each roofing shingle and adjacent the front edge of each roofing shingle (e.g., along the top and bottom edges of each gap defined along the roofing shingles) further may comprise one or more horizontal bands of a different type, color, shade, tint, or hue from the granules 41/42 to simulate a visual blending of colors or shading. In addition, in embodiments, the shadow lines positioned along the top edges of the gaps of the roofing shingles further may comprise a different color, shade, tint, or hue (e.g., can be darker in appearance) than the shadow lines positioned along the bottom edges of the gaps, to create different aesthetic features or visual impressions, such as to simulate increased thicknesses or bulk between layers, simulate multiple layers, or combinations thereof, along the areas of transition between the headlap and the exposed front surface, versus providing an impression of increased depth, separation, multiple layers, or combinations thereof, along the front edges of the roofing shingles when installed along a roof deck.

In embodiments, the dual shadow lines 60 can have a substantially consistent width ranging from about 1/16 inch to about 1½ inch, and in some embodiments, the shadow lines can have a width of 1/16 inch to 1⅜ inch, 1/16 inch to 1¼ inch, 1/16 inch to 1 inch, 1/16 inch to ⅞ inch, 1/16 inch to ¾ inch, 1/16 inch to ⅝ inch, 1/16 inch to ½ inch, 1/16 inch to ⅜ inch, 1/16 inch to ¼ inch, 1/16 inch to ⅛ inch, ⅛ inch to 1½ inch, ⅛ inch to 1⅜ inch, ⅛ inch to 1¼ inch, ⅛ inch to 1 inch, ⅛ inch to ⅞ inch, ⅛ inch to ¾ inch, ⅛ inch to ⅝ inch, ⅛ inch to ½ inch, ⅛ inch to ⅜ inch, ⅛ inch to ¼ inch, ¼ inch to 1½ inch, ¼ inch to 1⅜ inch, ¼ inch to 1¼ inch, ¼ inch to 1 inch, ¼ inch to ⅞ inch, ¼ inch to ¾ inch, ¼ inch to ⅝ inch, ⅛ inch to ½ inch, ¼ inch to ⅜ inch, ⅜ inch to 1½ inch, ⅜ inch to 1⅜ inch, ⅜ inch to 1¼ inch, ⅜ inch to 1 inch, ⅜ inch to ⅞ inch, ⅜ inch to ¾ inch, ⅜ inch to ⅝ inch, ⅜ inch to ½ inch, ½ inch to 1½ inch, ½ inch to 1⅜ inch, ½ inch to 1¼ inch, ½ inch to 1 inch, ½ inch to ⅞ inch, ½ inch to ¾ inch, ½ inch to ⅝ inch, ⅝ inch to 1½ inch, ⅝ inch to 1⅜ inch, ⅝ inch to 1¼ inch, ⅝ inch to 1 inch, ⅝ inch to ⅞ inch, ⅝ inch to ¾ inch, ¾ inch to 1½ inch, ¾ inch to 1⅜ inch, ¾ inch to 1¼ inch, ¾ inch to 1 inch, ¾ inch to ⅞ inch, ⅞ inch to 1½ inch, ⅞ inch to 1⅜ inch, ⅞ inch to 1¼ inch, ⅞ inch to 1 inch, 1 inch to 1½ inch, 1 inch to 1⅜ inch, 1 inch to 1¼ inch, 1¼ inch to 1½ inch, 1¼ inch to 1⅜ inch, or 1⅜ inch to 1½ inch.

Still further, in some embodiments, the application of the fines, granules, paint, or colorant materials of the shadow lines can be controlled to apply greater thickness or width to such materials for the shadow lines. For example, for multilayer, laminated roofing shingles, such as shown in FIGS. 1, 3 and 4A, greater amounts of the fines, granules, and/or other materials can be deposited or applied along areas of the back sheet 13 (FIGS. 2B and 4B), corresponding to the top and bottom edges of the gaps or the exposed front surface of the back sheet. As the top sheet and back sheet are placed in registration with each other during manufacture of the roofing shingles, the thickness or visible width of the shadow lines can be adjusted by adjusting the positioning of the top sheet and the back sheet with respect to one another.

In embodiments, the roofing shingles can be manufactured by conveying a shingle material substrate along a path of travel. In embodiments, a coating material, such as an asphalt or modified bituminous coating material can be applied to the first surface of the substrate, or in other embodiments, the substrate can be permeated with an asphalt or modified bituminous, or other coating material. As the substrate moves along its path of travel, it can pass through one or more granule dispensing stations for application of headlap and butt granules thereto.

In embodiments where roofing shingles comprise single layer or strip shingles, after passing through one or more granule dispensing stations which apply a plurality of headlap and butt granules along different areas or portions of the substrate, the substrate can be moved through a shadow line application station for application of fines or granules to form dual shadow lines along the substrate. In embodiments, the dual shadow lines can be applied to an upper or top surface of the substrate and can be applied intermittently as to form to lines, dashes or, stripes or patches in selected areas along the upper surface. For example, fines or granules forming each of the shadow lines can be deposited intermittently at areas commonly corresponding to top and bottom edges of simulated gaps defined along the surface of the substrate. Thereafter, the substrate can be cut in lengths to form the roofing shingles.

In other embodiments, such as where the roofing shingles comprise multi-layer roofing shingles (e.g., 2 layer laminated roofing shingles) the substrate can be separated or cut into strips that can form top and back sheets of the roofing shingles. In other embodiments, first and second roofing shingle material substrates can be fed along individual paths of travel, with, for example, the first substrate fed through one or more granule dispensing stations that apply headlap and butt granules to a first surface thereof, while the second substrate can move through one or more granule dispensing stations that dispense and apply a plurality of butt granules to the first surface thereof.

In embodiments, a series of tab openings or gaps can be formed along a portion the substrate (e.g., gaps can be cut or stamped out of the substrate to define a plurality of tabs or teeth). For two layer roofing shingles, the first substrate can comprise the top sheet of the roofing shingles and include a headlap having a plurality of headlap granules applied thereto, and a plurality of tabs or teeth with gaps or openings therebetween, and to which a plurality of granules can be applied.

Still further, in embodiments, the substrate can be passed through one or more shadow line application stations positioned along its path of travel. In embodiments, the shadow line application stations can include one or more fines or granule applicators, which, in some embodiments, can include a supply of fines or granules (e.g., a hopper with a plurality of granule contained therein) and a dispensing mechanism. In embodiments, the dispensing mechanism can comprise a drum or wheel a width of ⅛ inch to ½ inch, ⅛ inch to ¼ inch, or ¼ inch to ½ inch, and having a series of pockets or troughs defined thereabout that dispense the fines or granules as the drum is rotated, and which can be connected to a drive mechanism, such as a motor.

In embodiments, the hopper further can be configured with a dispensing opening adjacent a lower end thereof. The width of the dispensing opening can be adjusted or varied. For example, in embodiments, the dispensing opening can be 1/16th inch to 1 inch, 1/16 inch to ⅞ inch, 1/16 inch to ¾ inch, 1/16 inch to ⅝ inch, 1/16 inch to ½ inch, 1/16 inch to ⅜ inch, 1/16 to ¼ inch, 1/16 inch to ⅛ inch, 1/16 inch to 1⅜ inch, ⅛ inch to 1¼ inch, ⅛ inch to 1 inch, ⅛ inch to ⅞ inch, ⅛ inch to ¾ inch, ⅛ inch to ⅝ inch, ⅛ inch to ½ inch, ⅛ inch to ⅜ inch, ⅛ inch to ¼ inch, ¼ inch to 1½ inch, ¼ inch to 1⅜ inch, ¼ inch to 1¼ inch, ¼ inch to 1 inch, ¼ inch to ⅞ inch, ¼ inch to ¾ inch, ¼ inch to ⅝ inch, ⅛ inch to ½ inch, ¼ inch to ⅜ inch, ⅜ inch to 1½ inch, ⅜ inch to 1⅜ inch, ⅜ inch to 1¼ inch, ⅜ inch to 1 inch, ⅜ inch to ⅞ inch, ⅜ inch to ¾ inch, ⅜ inch to ⅝ inch, ⅜ inch to ½ inch, ½ inch to 1½ inch, ½ inch to 1⅜ inch, ½ inch to 1¼ inch, ½ inch to 1 inch, ½ inch to ⅞ inch, ½ inch to ¾ inch, ½ inch to ⅝ inch, ⅝ inch to 1½ inch, ⅝ inch to 1⅜ inch, ⅝ inch to 1¼ inch, ⅝ inch to 1 inch, ⅝ inch to ⅞ inch, ⅝ inch to ¾ inch, ¾ inch to 1½ inch, ¾ inch to 1⅜ inch, ¾ inch to 1¼ inch, ¾ inch to 1 inch, ¾ inch to ⅞ inch, ⅞ inch to 1½ inch, ⅞ inch to 1⅜ inch, ⅞ inch to 1¼ inch, ⅞ inch to 1 inch. Other opening sizes can be provided.

In one embodiment, the fines or granule dispensers, or other applicator of the shadow line application station (e.g., for an application of paint) can apply a plurality of fines or granules along the second substrate adjacent first and second or top and bottom edges thereof to form dual shadow lines along selected portions of the substrate (e.g., adjacent the top and bottom edges of a second substrate). In embodiments, the fines or granules of the dual shadow lines can be substantially continuously fed so as to form substantially continuous or varied shadow lines, while in other embodiments, the fines or granules of the shadow lines can be intermittently applied forming lines, stripes, dashes, or patches such fines or granules defining the dual shadow lines. Thereafter, the second substrate can be cut in lengths corresponding to a length of the roofing shingles, and can define a back sheet of each of the roofing shingles, and the top sheet and the back sheet can be brought into registration and attached, such as along a common bond area. The common bond area can include adhesive material or other attachment so as to secure the top sheet and the back sheet together.

FIGS. 7A-8B illustrate a series of sample roofing shingles and test installations of such roofing shingles utilized as part of survey testing performed testing samples of roofing shingles including dual shadow lines of various thicknesses. The survey testing was conducted with 66 randomly selected participants. Of the survey participants, approximately 76% of the survey participants (50 participants) owned their own home. To conduct the survey, the survey participants were shown two contrasting sample sets, including a sample set of roofing shingles having lighter color granules and a sample set of roofing shingles with darker color granules.

Figure 8A:
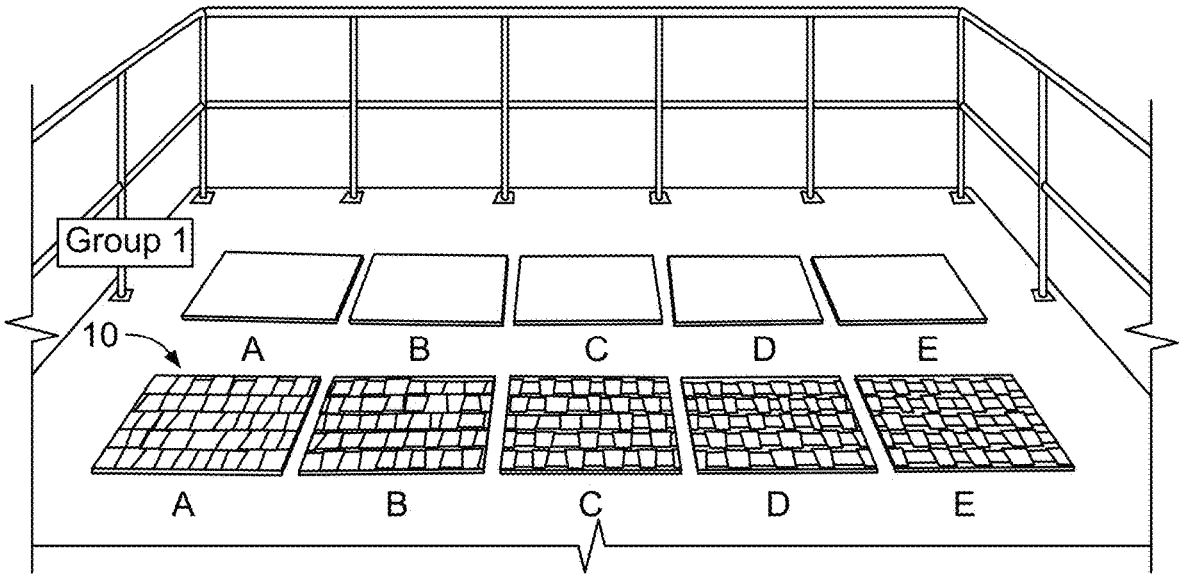
FIGS. 8A and 8B illustrate test installations of embodiments of roofing shingles such as shown in FIGS. 7A-7B with different thickness shadow lines.
Figure 8B:
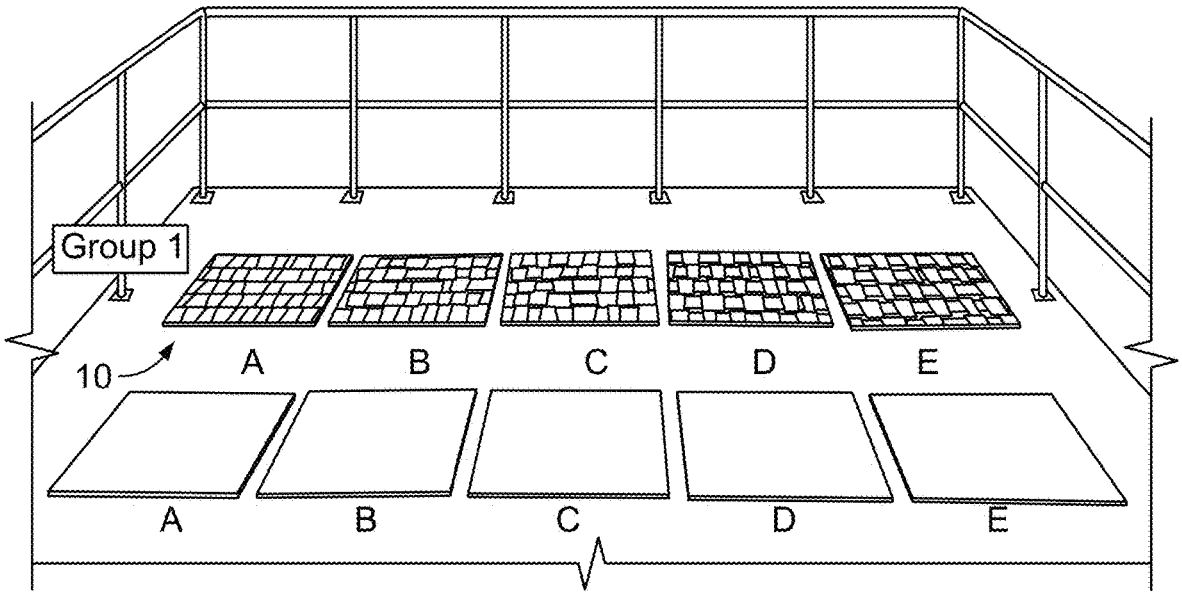

As shown in FIGS. 8A and 8B, the sample roofing shingles were installed in courses of overlapping roofing shingles along outdoor test roof decks to simulate viewing conditions as would normally be experienced by the survey participants viewing the roofing shingles as would be installed on a roof from a street level, e.g., with the samples being shown to the survey participants on a generally sunny day and at a distance of about 20 feet. Two different test installations of the different color sets of roofing shingles were used, with the sample sets being arranged in random order, and with the survey participants being randomly selected for viewing each of the different sample sets.

Figure 7A:
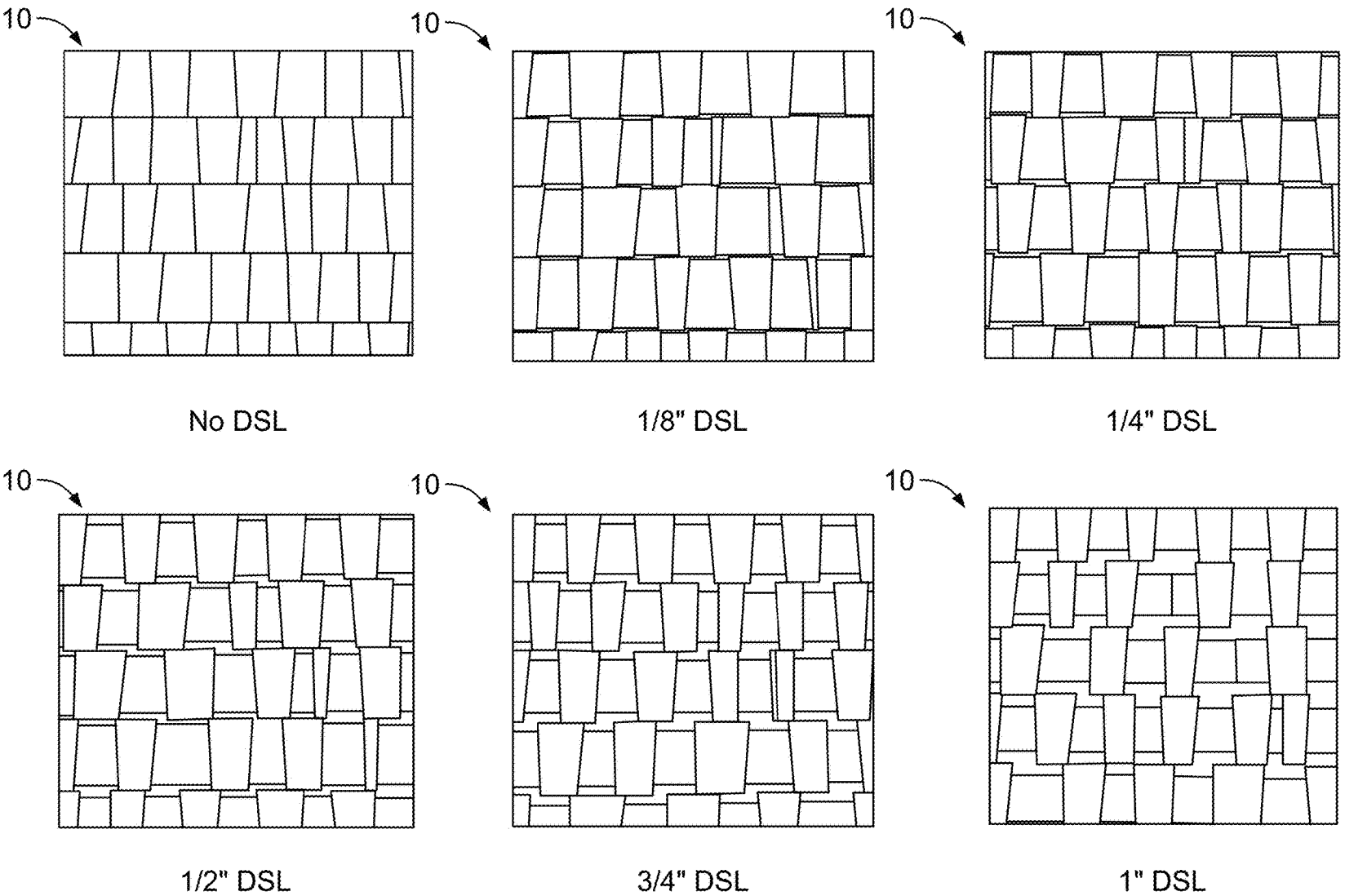
FIGS. 7A and 7B are top plan views illustrating example embodiments of roofing systems including embodiments of roofing shingles having different colors, according to the principles of the present disclosure.
Figure 7B:
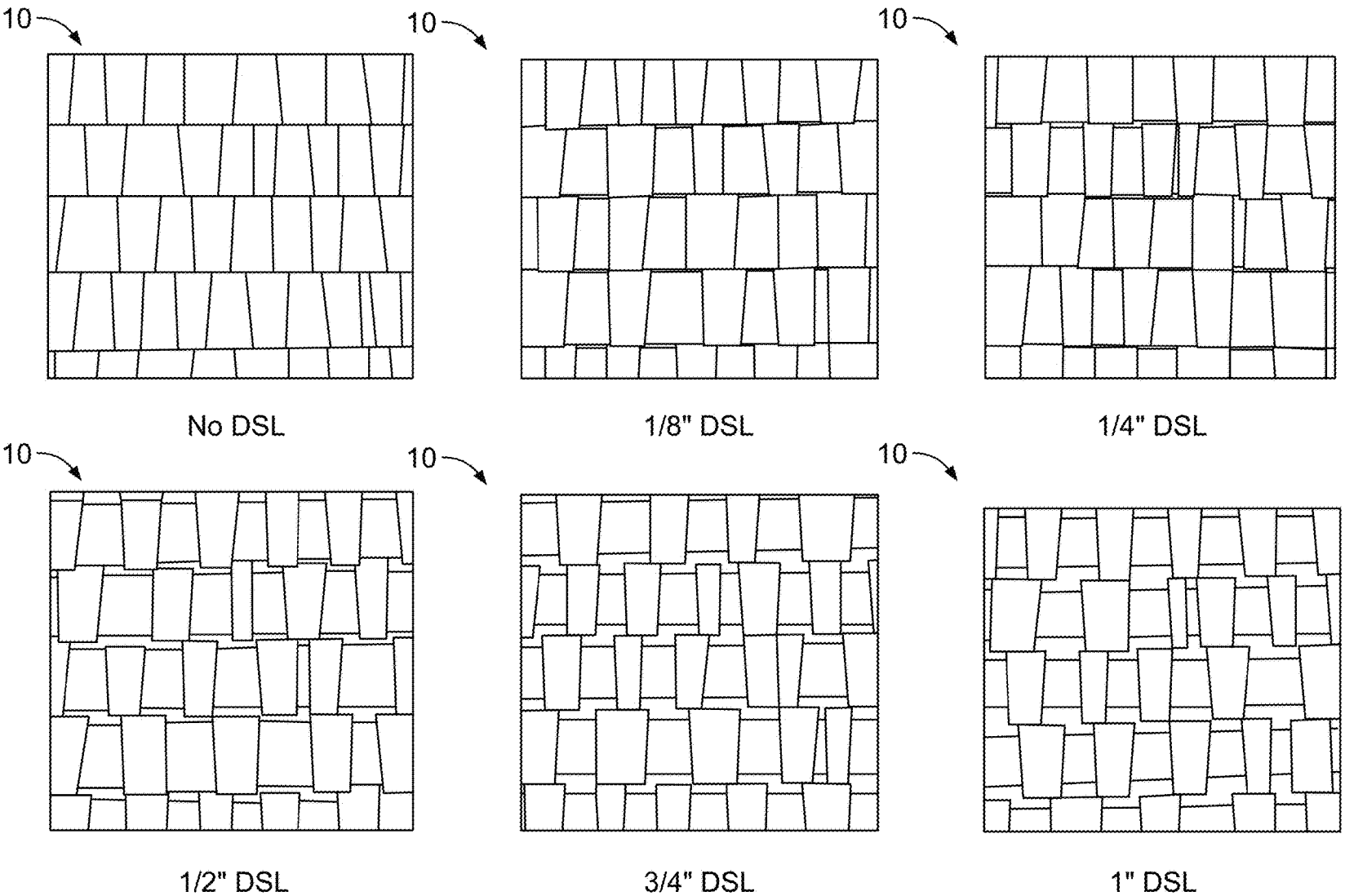

As illustrated in FIGS. 7A and 7B, the different sample sets of roofing shingles tested included two-layer laminated roofing shingles configured with dual shadow lines positioned along the top and bottom edges of the gaps between the tabs of the roofing shingles (e.g., along the upper portion and the lower portion of the exposed front surface of the back sheet of each roofing shingle). The shadow lines of the roofing shingles of each sample varied in thickness or visible width, and included roofing shingles having no dual shadow lines, roofing shingles with ¼ inch shadow lines, roofing shingles with ¼ inch shadow lines, roofing shingles with ½ inch shadow lines, roofing shingles with ¾ inch shadow lines, and roofing shingles with 1 inch shadow lines.

The survey participants were asked to provide feedback regarding their impressions of each of the samples of roofing shingles, including their impressions of the overall appearance of the roofing shingles of each sample set of roofing shingles, which color definition and contrast between individual shingles of each set of sample roofing shingles they preferred, which roofing shingles had a more natural appearance, and their preferences as to which of the different thickness shadow lines they found to have the most impact visually and which they preferred.

Figure 9:
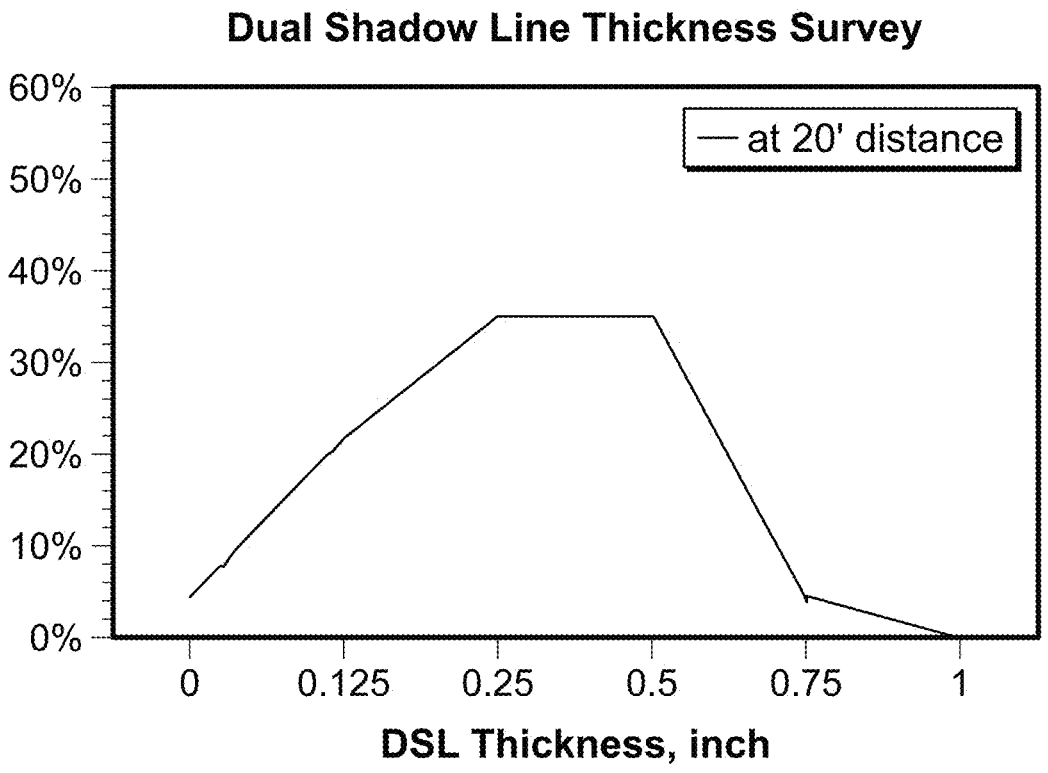
FIG. 9 is a graph illustrating the results of a survey conducted using test installations of the roofing shingles shown in FIGS. 8A-8B.

As an initial response, 73% of the survey participants (48 participants) responded that the width of the shadow lines created a significant visual impact to the roofing shingles. Overall, as indicated in FIG. 9, the survey participants indicated a preference for roofing shingles having shadow lines with a thickness or width of ¼ inch, with the majority of the survey participants indicating a preference for shadow lines with a thickness or width of between ¼ inch and ½ inch, with a strong preference for the ¼ inch shadow lines.

The survey participants reported factors such as the ¼ inch shadow lines creating a more subtle contrast between the different color granules of the roofing shingles while providing an appearance of more depth and dimension, creating a clean looking separation between the headlap and the plurality of tabs and exposed front surface and between adjacent roofing shingles of each course of roofing shingles that added dimensionality to the roofing shingles, particularly at areas along the front or butt ends of the roofing shingles of a higher course and the adjacent roofing shingles of a lower course. The survey participants further indicated that the thicker shadow lines (particularly shadow lines of ¾ inch to 1 inch) were much more noticeable and created an unappealing appearance that looked "jarring" and strange.

The survey participants were further asked about their preferred choice of roofing shingle and shadow line thickness or width, and whether they would install roofing shingles including shadow lines having their preferred shadow line thickness or width on their own home, with 64% responding that they were likely to install such roofing shingles on their own homes.

The ¼ inch shadow line was accordingly found to create a more preferred and natural looking roofing shingle having a subtle color transition between butt and headlap granules of the roofing shingle and an appearance of increased depth and dimension between layers of the roofing shingles and between adjacent roofing shingles of overlapping courses of roofing shingles installed along a roof deck; and it is further understood that, in embodiments, the ¼ inch shadow line can provide for a reduction in materials and waste required for manufacture of the roofing shingles.

The foregoing description generally illustrates and describes various embodiments of the present disclosure. It will, however, be understood by those skilled in the art that various changes and modifications can be made to the above-discussed construction of the present disclosure without departing from the spirit and scope of the present disclosure as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present disclosure. Accordingly, various features and characteristics of the present disclosure as discussed herein may be selectively interchanged and applied to other illustrated and non-illustrated embodiments of the present disclosure, and numerous variations, modifications, and additions further can be made thereto without departing from the spirit and scope of the present disclosure.

What is claimed is:

1. A roofing shingle comprising:
a top sheet,
wherein the top sheet comprises:
a headlap; and
a plurality of tabs extending from a side of the headlap;
a back sheet attached to the top sheet,
wherein the back sheet underlies the plurality of tabs such that the back sheet has an exposed front surface between each of the plurality of tabs;
wherein the exposed front surface of the back sheet has:
an upper portion;
a lower portion; and
an intermediate portion between the upper portion and the lower portion;
wherein the back sheet comprises:
a first plurality of granules having a first color;
a second plurality of granules having a second color;
wherein the first plurality of granules is located in the upper portion and the lower portion of the exposed front surface of the back sheet;
wherein the first plurality of granules located in the upper portion and the lower portion are the same first color:
wherein the upper portion and the lower portion each have a width of ¼ inch to ½ inch;
wherein the second plurality of granules is located in the intermediate portion of the exposed front surface of the back sheet;
wherein the first color is darker than the second color.

2. The roofing shingle of claim 1, wherein the upper portion of the exposed front surface of the back sheet has a width of ¼ inch to ⅜ inch.

3. The roofing shingle of claim 1, wherein the lower portion of the exposed front surface of the back sheet has a width of ¼ inch to ⅜ inch.

4. The roofing shingle of claim 1, wherein the first plurality of granules is not located in the intermediate portion of the exposed front surface of the back sheet.

5. The roofing shingle of claim 1, wherein the top sheet comprises a third plurality of granules having a third color, wherein the first color is darker than the third color.

6. The roofing shingle of claim 5, wherein the third plurality of granules is located on the plurality of tabs of the top sheet.

7. The roofing shingle of claim 5, wherein the second color is different from the third color.

8. A stack comprising:
a plurality of roofing shingles,
wherein each of the plurality of roofing shingles comprises:
a top sheet,
wherein the top sheet comprises:
a headlap; and
a plurality of tabs extending from a side of the headlap;
a back sheet attached to the top sheet,
wherein the back sheet underlies the plurality of tabs such that the back sheet has an exposed front surface between each of the plurality of tabs;
wherein the exposed front surface of the back sheet has:
an upper portion;
a lower portion; and
an intermediate portion between the upper portion and the lower portion;
wherein the back sheet comprises:
a first plurality of granules having a first color;
a second plurality of granules having a second color;
wherein the first plurality of granules is located in the upper portion and the lower portion of the exposed front surface of the back sheet;
wherein the first plurality of granules located in the upper portion and the lower portion are the same first color;
wherein the upper portion and the lower portion each have a width of ¼ inch to ½ inch;
wherein the second plurality of granules is located in the intermediate portion of the exposed front surface of the back sheet;

wherein the first color is darker than the second color.

9. The stack of claim 8, wherein the upper portion of the exposed front surface of the back sheet has a width of ¼ inch to ⅜ inch.

10. The stack of claim 8, wherein the lower portion of the exposed front surface of the back sheet has a width of ¼ inch to ⅜ inch.

11. The stack of claim 8, wherein the first plurality of granules is not located in the intermediate portion of the exposed front surface of the back sheet.

12. The stack of claim 8, wherein the top sheet comprises a third plurality of granules having a third color, wherein the first color is darker than the third color.

13. A system comprising:

a roofing substrate; and a plurality of roofing shingles located on the roofing substrate, wherein each of the plurality of roofing shingles comprises:

a top sheet, wherein the top sheet comprises:

a headlap; and a plurality of tabs extending from a side of the headlap;

a back sheet attached to the top sheet, wherein the back sheet underlies the plurality of tabs such that the back sheet has an exposed front surface between each of the plurality of tabs;

wherein the exposed front surface of the back sheet has:

an upper portion;

a lower portion; and an intermediate portion between the upper portion and the lower portion;

wherein the back sheet comprises:

a first plurality of granules having a first color;

a second plurality of granules having a second color;

wherein the first plurality of granules is located in the upper portion and the lower portion of the exposed front surface of the back sheet;

wherein the first plurality of granules located in the upper portion and the lower portion are the same first color;

wherein the upper portion and the lower portion each have a width of ¼ inch to ½ inch;

wherein the second plurality of granules is located in the intermediate portion of the exposed front surface of the back sheet;

wherein the first color is darker than the second color.

14. The system of claim 13, wherein the roofing substrate comprises at least one of a roof deck, an underlayment, or any combination thereof.

15. The system of claim 13, wherein the upper portion of the exposed front surface of the back sheet has a width of ¼ inch to ⅜ inch.

16. The system of claim 13, wherein the lower portion of the exposed front surface of the back sheet has a width of ¼ inch to ⅜ inch.

17. The system of claim 13, wherein the first plurality of granules is not located in the intermediate portion of the exposed front surface of the back sheet.

18. The system of claim 13, wherein the top sheet comprises a third plurality of granules having a third color, wherein the first color is darker than the third color.

19. The system of claim 18, wherein the first color is darker than the third color.

20. The system of claim 18, wherein the second color is different from the third color.

* * * * *